US008378960B2

(12) United States Patent
Kangas et al.

(10) Patent No.: US 8,378,960 B2
(45) Date of Patent: Feb. 19, 2013

(54) APPARATUS, SYSTEM, AND METHOD FOR CONTROLLING AN ELECTRONIC DISPLAY

(75) Inventors: Paul D. Kangas, Research Triangle Park, NC (US); Robert T. Noble, Research Triangle Park, NC (US)

(73) Assignee: International Business Machines Corporation, Armonk, NY (US)

( * ) Notice: Subject to any disclaimer, the term of this patent is extended or adjusted under 35 U.S.C. 154(b) by 477 days.

(21) Appl. No.: 12/541,016

(22) Filed: Aug. 13, 2009

(65) Prior Publication Data

US 2011/0037781 A1 Feb. 17, 2011

(51) Int. Cl.
*G09G 3/36* (2006.01)

(52) U.S. Cl. ..... 345/102; 345/211

(58) Field of Classification Search ..... 345/102, 345/211

See application file for complete search history.

(56) References Cited

U.S. PATENT DOCUMENTS

| | | | | |
|---|---|---|---|---|
| 6,731,274 | B2 | 5/2004 | Powell | |
| 7,205,973 | B2 | 4/2007 | Ma et al. | |
| 2003/0071805 | A1 * | 4/2003 | Stanley | 345/211 |
| 2004/0155854 | A1 * | 8/2004 | Ma et al. | 345/102 |
| 2005/0219271 | A1 * | 10/2005 | Tanaka | 345/690 |
| 2005/0270265 | A1 * | 12/2005 | Plut | 345/102 |
| 2006/0192748 | A1 * | 8/2006 | Lowles et al. | 345/102 |

FOREIGN PATENT DOCUMENTS

JP 2000243074 A 9/2000

OTHER PUBLICATIONS

PCT/EP2010/061680, International Search Report and Written Opinion, Sep. 17, 2010.

* cited by examiner

*Primary Examiner* — Viet Pham

(74) *Attorney, Agent, or Firm* — Kunzler Law Group, PC

(57) ABSTRACT

An apparatus, system, and method are disclosed for controlling an electronic display. An activity module receives a brightness restore signal and sets a brightness level of an electronic display to a default brightness level in response to the brightness restore signal. A brightness decay module dims the brightness level of the electronic display from the default brightness level to an intermediate brightness level at a first dimming rate. The intermediate brightness level is selected from one or more intermediate brightness levels. A plateau module maintains the brightness level of the electronic display at the intermediate brightness level for a predefined period of time. A minimum brightness module dims the brightness level of the electronic display from an intermediate brightness level to a minimum brightness level at a second dimming rate.

19 Claims, 6 Drawing Sheets

APPARATUS, SYSTEM, AND METHOD FOR CONTROLLING AN ELECTRONIC DISPLAY

BACKGROUND

1. Field of the Invention

This invention relates to electronic displays and more particularly relates to controlling a brightness level of an electronic display.

2. Description of the Related Art

Electronic displays are becoming increasingly ubiquitous. Electronic displays are used in computer systems, televisions, gas station pumps, advertisements, cash registers, toys, vehicles, telephones, handhelds, and in countless other devices. An electronic display, however, uses a large portion of the total power consumed by a device. This increases the cost of powering a device, and decreases the battery life of portable devices.

Additionally, many electronic displays have finite lifetimes, after which a display may exhibit decreased usability or be unusable. Often, an electronic display's backlight uses the majority of the power consumed by the electronic display. The backlight may also be the component that determines the lifetime of an electronic display, fading with use. In some environments, such as retail environments, electronic displays are in nearly continuous use throughout the day, and sometimes around the clock. This constant use wears out electronic displays, and consumes large amounts of power. Users also routinely set the brightness level of an electronic display to the maximum level. The higher the brightness level of an electronic display, the more power that the display consumes, and the shorter the operating life of the display.

While electronic displays sometimes have user configurable display settings, many companies have large numbers of electronic displays. For example, a company may have a computer monitor for each employee, a retail chain may have several cash registers in each store, and a gas station chain may have a display at each pump. The aggregate power consumption costs of these electronic displays can be large, and there is currently no easy way to propagate uniform display settings across multiple electronic displays.

BRIEF SUMMARY

From the foregoing discussion, it should be apparent that a need exists for an apparatus, system, and method that decrease power consumption of electronic displays. Beneficially, such an apparatus, system, and method would be configurable for multiple electronic displays.

The present invention has been developed in response to the present state of the art, and in particular, in response to the problems and needs in the art that have not yet been fully solved by currently available electronic display control methods. Accordingly, the present invention has been developed to provide an apparatus, system, and method for controlling an electronic display that overcome many or all of the above-discussed shortcomings in the art.

The apparatus to control an electronic display is provided with a plurality of modules configured to functionally execute the necessary steps of controlling an electronic display. These modules in the described embodiments may include an activity module, a brightness decay module, a plateau module, a minimum brightness module, a configuration module, a multiple plateau module, and a brightness override module.

In one embodiment, the apparatus includes an activity module that receives a brightness restore signal and sets a brightness level of an electronic display to a default brightness level in response to the brightness restore signal. In another embodiment, the apparatus includes a brightness decay module that dims the brightness level of the electronic display from the default brightness level to an intermediate brightness level at a first dimming rate. The intermediate brightness level is selected from one or more intermediate brightness levels.

In another embodiment, the apparatus includes a plateau module that maintains the brightness level of the electronic display at the intermediate brightness level for a predefined period of time. In one embodiment, the predefined period of time begins running in response to the plateau module receiving a brightness release signal. In yet another embodiment, the apparatus includes a minimum brightness module that dims the brightness level of the electronic display from an intermediate brightness level to a minimum brightness level at a second dimming rate.

In one embodiment, the apparatus includes a configuration module that receives a custom definition of at least one of the intermediate brightness level, the default brightness level, the predefined period of time, the first dimming rate, the second dimming rate, and the minimum brightness level. In a further embodiment, the configuration module receives the custom definition over a network from a display management server or controller that manages display settings for a plurality of electronic displays. In another further embodiment, the configuration module receives the custom definition over a Display Data Channel ("DDC") Inter-Integrated Circuit ("I2C") communications bus, universal serial bus ("USB"), or other similar data communication means.

In one embodiment, the apparatus includes a multiple plateau module that dims the brightness level of the electronic display from the intermediate brightness level to one or more additional intermediate brightness levels at a dimming rate and maintains the brightness level of the electronic display at each of the additional intermediate brightness levels for one or more predefined periods of time. In another embodiment, the apparatus includes a brightness override mode module that temporarily sets the brightness level of the electronic display to a brightness level higher than a maximum normal use brightness level.

In another embodiment, the brightness decay module begins dimming the brightness level of the electronic display from the default brightness level to the intermediate brightness level substantially immediately in response to the activity module setting the brightness level of the electronic display to the default brightness level. In a further embodiment, the brightness decay module begins dimming the brightness level of the electronic display within some predetermined time interval, for example about ten seconds, of the activity module setting the brightness level of the electronic display to the default brightness level.

In one example, the activity module receives the brightness restore signal from a user input device. In a further example, the user input device is disposed on a housing of the electronic display. In another example, dimming the brightness level of the electronic display comprises dimming the brightness level of the electronic display in discrete increments that are imperceptible to a user. In another example, the first dimming rate and the second dimming rate comprise nonlinear dimming rates. In a further example, a slope of the first dimming rate increases as the brightness level of the electronic display approaches the intermediate brightness level and where a slope of the second dimming rate decreases as the brightness level of the electronic display approaches the minimum brightness level.

In one embodiment, the electronic display is off at the minimum brightness level. In another embodiment, the intermediate brightness level comprises a visible brightness level, wherein a displayed image is distinguishable to a user.

Another apparatus of the present invention is also presented to control an electronic display. The apparatus may include a configuration module that receives a custom definition of at least one of a default brightness level, an intermediate brightness level, a predefined period of time, a first dimming rate, a second dimming rate, and a minimum brightness level over a network from a display management server or controller over a Display Data Channel ("DDC") Inter-Integrated Circuit ("I2C") communications bus, USB, or other similar data communication means, the display management server or controller managing display settings for a plurality of electronic displays. The apparatus includes an activity module that receives a brightness restore signal from a user input device and sets a brightness level of an electronic display to the default brightness level in response to the brightness restore signal.

The apparatus includes a brightness decay module that dims the brightness level of the electronic display from the default brightness level to the intermediate brightness level at the first dimming rate, the intermediate brightness level selected from one or more intermediate brightness levels. The apparatus includes a plateau module that maintains the brightness level of the electronic display at the intermediate brightness level for the predefined period of time and a minimum brightness module that dims the brightness level of the electronic display from an intermediate brightness level to the minimum brightness level at the second dimming rate.

A system of the present invention is also presented to control an electronic display. The system may be embodied by an electronic display having a brightness level that is adjustable and a display controller that sets the brightness level of the electronic display. The display controller may include an activity module that receives a brightness restore signal and sets the brightness level of the electronic display to a default brightness level in response to the brightness restore signal. The display controller may include a brightness decay module that dims the brightness level of the electronic display from the default brightness level to an intermediate brightness level at a first dimming rate, the intermediate brightness level selected from one or more intermediate brightness levels.

The display controller may include a plateau module that maintains the brightness level of the electronic display at the intermediate brightness level for a predefined period of time. The display controller may include a minimum brightness module that dims the brightness level of the electronic display from an intermediate brightness level to a minimum brightness level at a second dimming rate.

In one embodiment, the electronic display has a brightness level that is adjustable. The display controller, in a further embodiment, sets the brightness level of the electronic display. In another embodiment, the display controller comprises the activity module, the brightness decay module, the plateau module, and the minimum brightness module, described above.

In a further embodiment, the system includes a display management server that manages display settings for the electronic display and for a plurality of additional electronic displays. In one embodiment, the display management server defines at least one of the intermediate brightness level, the default brightness level, the predefined period of time, the first dimming rate, the second dimming rate, and the minimum brightness level over a network.

A method of the present invention is also presented for controlling an electronic display. The method in the disclosed embodiments substantially includes the steps necessary to carry out the functions presented above with respect to the operation of the described apparatus and system.

In particular, in one embodiment, the method includes receiving a brightness restore signal. In a further embodiment, the method includes setting a brightness level of an electronic display to a default brightness level in response to the brightness restore signal. The method, in another embodiment, includes dimming the brightness level of the electronic display from the default brightness level to an intermediate brightness level at a first dimming rate. In one embodiment, the intermediate brightness level is selected from one or more intermediate brightness levels.

In one embodiment, the method includes maintaining the brightness level of the electronic display at the intermediate brightness level for a predefined period of time. In a further embodiment, the method includes dimming the brightness level of the electronic display from an intermediate brightness level to a minimum brightness level at a second dimming rate. In another embodiment, the method includes the step of dimming the brightness level of the electronic display from the intermediate brightness level to a second intermediate brightness level and maintaining the brightness level of the electronic display at the second intermediate brightness level for a second predefined period of time.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
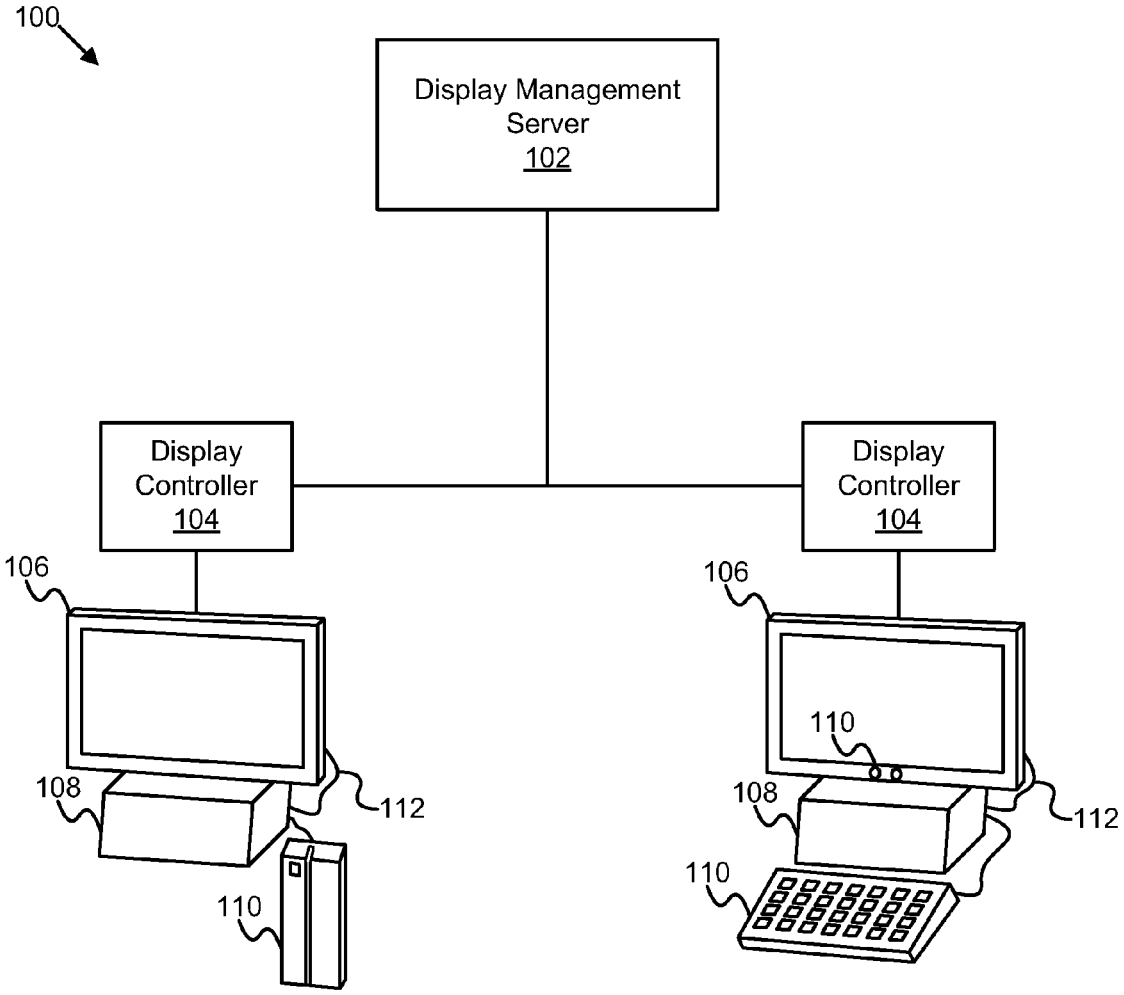
FIG. 1 is a schematic block diagram illustrating one embodiment of a system for controlling an electronic display in accordance with the present invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and maybe embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the software portions are stored on one or more computer readable media.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Reference to computer readable media may take any form capable of storing machine-readable instructions on a digital processing apparatus. A computer readable medium maybe embodied by a compact disk, digital-video disk, a magnetic tape, a Bernoulli drive, a magnetic disk, a punch card, flash memory, integrated circuits, or other digital processing apparatus memory device.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIG. 1 depicts one embodiment of a system 100 for controlling an electronic display. In general, the system 100 controls a brightness level of an electronic display to minimize power consumption and to extend the life of the electronic display. In the depicted embodiment, the system 100 comprises a display management server 102, one or more display controllers 104, one or more electronic displays 106, one or more computing devices 108, one or more user input devices 110, and one or more display connections 112, which are described below.

In one embodiment, the display management server 102 manages display settings for the one or more display controllers 104. Display settings are described in greater detail below with regard to the display controller 104. In general, display settings comprise definitions of display parameters, such as brightness levels, contrast levels, color settings, refresh rates, resolutions, time periods, dimming rates, and the like. The display management server 102, in one embodiment, may comprise a controller, a computing device, or the like. In a further embodiment, the display management server 102 may be integrated with one of the one or more display controllers 104, one of the one or more computing devices 108, or the like. In another embodiment, the display management server 102 comprises an independent device.

The display management server 102, in one embodiment, comprises a network server computing device that stores display settings for a plurality of electronic displays, including the one or more electronic displays 104. The display management server 102 may store display settings for each electronic display independently or may store a single set of uniform settings for the plurality of electronic displays. The display management server 102 may be in communication with the one or more display controllers 104 over a network. The network may comprise a data network, such as a local area network ("LAN"), the Internet, or the like, or a device network, connecting local devices using a communications bus, such as the one or more display connections 112, or the like. The display management server 102, in one embodiment, provides settings definitions to the one or more computing devices 108 over the network, and the one or more computing devices 108 provide the settings definitions to the one or more display controllers 104 over the one or more display connections 112.

In one embodiment, the one or more display controllers 104 set a brightness level of the one or more electronic displays 106. The one or more display controllers 104 are discussed in greater detail with regard to the display controller 104 of FIG. 2 and of FIG. 3. In general, each display controller 104 controls one of the electronic displays 106 by setting the brightness level of the electronic display 106 to a default brightness level, dimming the brightness level from the default brightness level to an intermediate brightness level at a first dimming rate, maintaining the brightness level at the intermediate brightness level for a predefined period of time, and dimming the brightness level to a minimum brightness level at a second dimming rate. Each display controller 104 may further return the brightness level to the default brightness level in response to a brightness restore signal.

The one or more display controllers 104, in a further embodiment, may receive custom definitions for one or more of the intermediate brightness level, the default brightness level, the predefined period of time, the first dimming rate, the second dimming rate, and the minimum brightness level. Custom display setting definitions allow each of the one or more electronic displays to be customized based on user preferences, use environment, management decisions, or other factors. The one or more display controllers 104 may receive custom definitions from the display management server 102, from a user, from the one or more computing devices 108, from another module, or the like.

The one or more display controllers 104 may further control or manage other aspects of the one or more electronic displays 106, such as display settings, communications with the one or more computing devices 108, displaying contents of a display signal, user inputs, and the like. The one or more display controllers 104 may comprise hardware controllers, processors, logic devices, programmable hardware devices, software code, and/or other display control logic. Each of the one or more display controllers 104 may be embedded within one of the electronic display devices 106, maybe integrated with one of the computing devices 108, or may otherwise be in communication with one or more of the electronic displays 106.

In one embodiment, the one or more electronic displays 106 are electrically powered display devices capable of displaying analog and/or digital display signals at an adjustable brightness level. Examples of such displays include Cathode Ray Tube ("CRT") displays, Liquid Crystal Diode ("LCD") displays, Light-Emitting Diode ("LED") displays, Organic LED ("OLED") displays, plasma displays, Surface-conduction Electron-emitter Displays ("SEDs"), laser video displays, backlit electronic paper displays, projection displays, and other displays having an adjustable brightness level. In one embodiment, a power consumption of the one or more electronic displays 106 decreases as the brightness level decreases.

The brightness level of each of the one or more electronic displays 106 may be continuously adjustable over a range of brightness levels, or may be adjustable through a set of discrete brightness levels. In one embodiment, each brightness level in the set of discrete brightness levels is substantially indistinguishable from adjacent brightness levels. Each of the one or more electronic displays 106 may have controls for setting the brightness level that are accessible to a display controller 104, allowing for dynamic brightness level control by the display controller 104.

In one embodiment, the one or more computing devices 108 each provide a display signal to an electronic display 106. Each electronic display 106 may visually display contents of a display signal from a computing device 108. The one or more computing devices 108 may comprise personal computers, retail cash register devices, television tuner devices, video player devices, gaming systems, or other devices capable of providing a display signal to an electronic display 106. In one embodiment, an electronic display 106 is integrated with a computing device 108 as a single unit.

The one or more computing devices 108, in a further embodiment, may provide display settings and custom definitions to the one or more display controllers 104. The one or more computing devices 108 may be in communication with the display management server 102 over a network and may receive display settings and custom definitions from the display management server 102, or the one or more computing devices 108 may receive display settings and custom definitions from a user, another module, or the like. In a further embodiment, the display management server 102 may be installed on or otherwise integrated with one of the one or more computing devices 108. In another embodiment, the one or more computing devices 108 may provide the brightness restore signal to the one or more display controllers 104.

In one embodiment, the one or more user input devices 110 receive input from a user. The one or more user input devices 110 may be in communication with the one or more computing devices 108, or may be in communication with the one or more electronic displays 106 or the one or more display controllers 104 directly. The one or more user input devices 110, in one embodiment, may comprise devices such as keyboards, keypads, buttons, mice, touch screens, touchpads, dials, switches, magnetic stripe readers, barcode scanners, and the like. In one embodiment, a user input device 110 is disposed on a housing of an electronic display 106, such as a button, dial, switch, or the like that may trigger a brightness refresh signal, provide On Screen Display ("OSD") navigation controls, set display settings, or the like.

In one embodiment, the one or more user input devices 110 receive display settings, such as custom definitions, from a user, and provide the display settings to the one or more computing devices 108, and/or to the one or more display controllers 104. In another embodiment, the one or more user input devices 110 provide the brightness restore signal to the one or more computing devices 108, and/or the one or more display controllers 104. The one or more user input devices 110 may provide the brightness restore signal in response to receiving input from a user, such as a movement, key press, card swipe, scan, or the like. In a further embodiment, the one or more user input devices 110 may comprise a sensor, a camera, or the like that detects a presence or a motion of a user and provides the brightness restore signal in response to the presence, motion, or the like.

The one or more computing devices 108, in one embodiment, are in communication with the one or more electronic displays 106 over the one or more display connections 112. Each of the one or more display connections 112 transmits signals between a computing device 108 and an electronic display 106. The one or more display connections 112 may transmit analog display signals, digital display signals, data such as display settings and custom definitions, brightness restore signals, and the like.

The one or more display connections 112, in one embodiment, may comprise a video connection such as a Video Graphics Array ("VGA") connection, a Digital Visual Interface ("DVI") connection, a High-Definition Multimedia Interface ("HDMI") connection, a component video connection, a composite video connection, a coaxial video connection, a display port connection, an S-video connection, a SCART connection, a D-Terminal connection, or the like. In a further embodiment, the one or more display connections may comprise a data connection such as a serial port connection, a Universal Serial Bus ("USB") connection, an IEEE 1394 ("FireWire") connection, an Ethernet connection, a Bluetooth connection, an IEEE 802.11 wireless connection, or the like. In one embodiment, the one or more display connections 112 comprise a video connection with a data channel, such as a Display Data Channel ("DDC") Inter-Integrated Circuit ("I2C") communications bus or another data channel connection. One of skill in the art will recognize other display connections 112.

Figure 2:
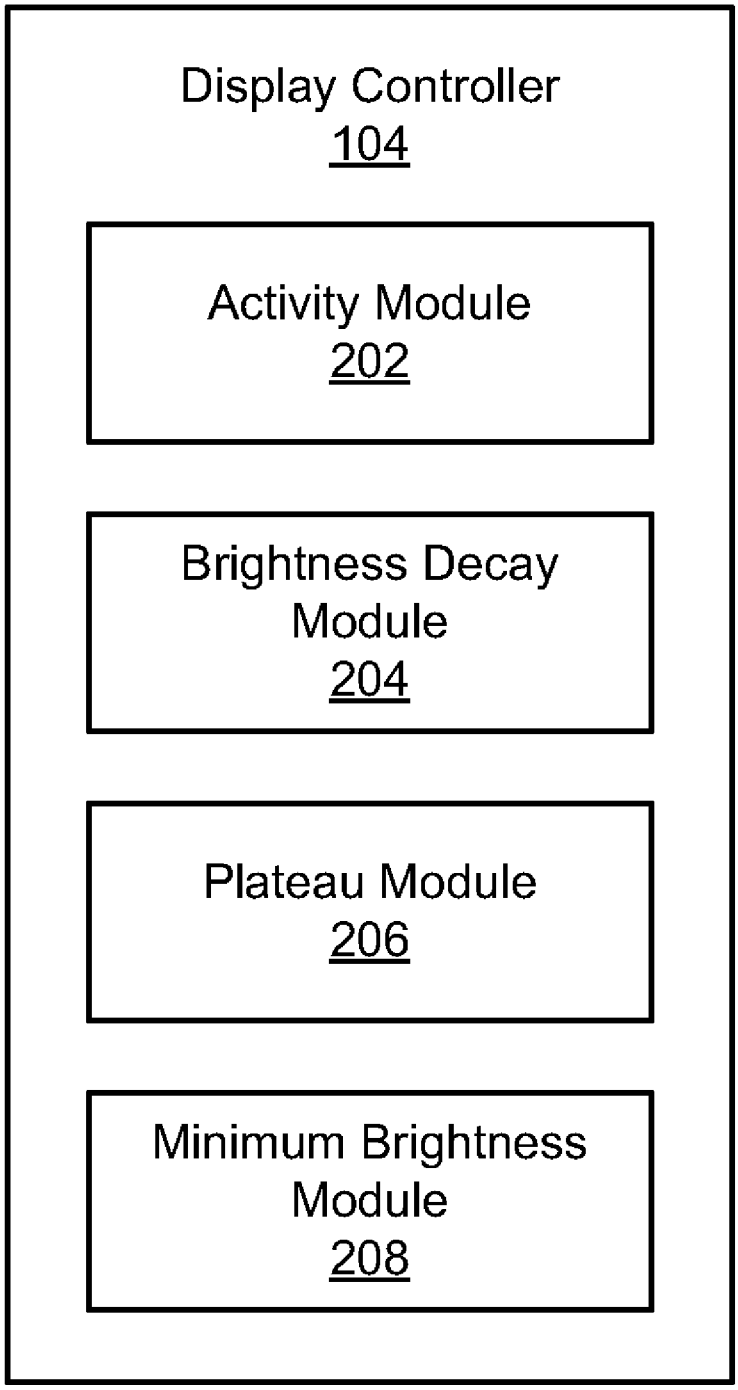
FIG. 2 is a schematic block diagram illustrating one embodiment of a display controller in accordance with the present invention.

FIG. 2 depicts one embodiment of the display controller 104. As described above, in general, the display controller 104 controls a brightness level of the electronic display 106. In the depicted embodiment, the display controller 104 comprises an activity module 202, a brightness decay module 204, a plateau module 206, and a minimum brightness module 208.

In one embodiment, the activity module 202 receives a brightness restore signal. The activity module 202 may receive the brightness restore signal from a computing device 108, from a user input device 110, from a sensor such as a motion, heat, or presence sensor, from a camera, or the like. The activity module 202 may receive the brightness restore signal in response to an action by a user, in response to a predefined use of the electronic display 106 such as playing video, advertising, or the like, or in response to another brightness restore scenario. The activity module 202 may receive a hardware or software interrupt indicating receipt of the brightness restore signal, may poll a register or a data structure that indicates receipt of the brightness restore signal, or may otherwise detect the brightness restore signal.

The activity module 202, in one embodiment, sets a brightness level of the electronic display 106 to a default brightness level in response to receiving the brightness restore signal. The default brightness level maybe defined by the display management server 102, by a user, by the computing device 108, by a manufacturer of the electronic display 106, by another module, or the like. The default brightness level may comprise a maximum normal use brightness level set by a manufacturer or the like, or a custom default brightness level that is lower than a maximum normal use brightness level. For example, a user or manager of the electronic display 106 may set the default brightness level at a level lower than a maximum normal use brightness level to reduce power consumption by the electronic display 106.

In one embodiment, the brightness decay module 204 dims the brightness level of the electronic display 106 from the default brightness level to an intermediate brightness level at a first dimming rate. The brightness decay module 204, in a further embodiment, begins dimming the brightness level of the electronic display 106 substantially immediately in response to the activity module 202 setting the brightness level of the electronic display to the default brightness level.

In one embodiment, there is little or no delay between the time that the activity module 202 sets the brightness level to the default brightness level and the time that the brightness decay module 204 begins dimming the brightness level. In another embodiment, the brightness decay module 204 begins dimming the brightness level within a predetermined period, for example about ten seconds, of the activity module 202 setting the brightness level to the default brightness level. By beginning to dim the brightness level substantially immediately instead of waiting, the brightness decay module 204 decreases power consumption of the electronic display 106.

The first dimming rate that the brightness decay module 204 uses may comprise a linear dimming rate or a nonlinear dimming rate. A nonlinear dimming rate may comprise a parabolic rate, an exponential rate, a stepping rate, or the like. For example, in one embodiment, a slope of the first dimming rate may increase as the brightness level of the electronic display approaches the intermediate brightness level, causing the brightness level to dim at an increasing speed as it approaches the intermediate brightness level. In one embodiment, the brightness decay module 204 dims the brightness level in discrete increments at the first dimming rate. The discrete increments may be substantially imperceptible to a user.

In one embodiment, the intermediate brightness level is selected from one or more intermediate brightness levels. As described above, the intermediate brightness level and the first dimming rate may be custom defined by the display management server 102, a user, or the like. In one embodiment, the intermediate brightness level comprises a visible brightness level, meaning that an image that the electronic display 106 displays is distinguishable to a user.

In one embodiment, the plateau module 206 maintains the brightness level of the electronic display 106 at the intermediate brightness level for a predefined period of time. As described above, the predefined period of time may be custom defined by the display management server 102, by a user, or the like. In one embodiment, the intermediate brightness level comprises a visible brightness level, and a user may continue to view and use the electronic display 106 during the predefined period of time. Because the intermediate brightness level is lower than the default brightness level, the electronic display 106 consumes less power at the intermediate brightness level than at the default brightness level.

In a further embodiment, the predefined period of time begins running in response to the plateau module 206 receiving a brightness release signal, such that the plateau module 206 maintains the brightness level at the intermediate brightness level for a predefined period of time after receiving the brightness release signal. While the brightness restore signal may signify a predefined user activity, in one embodiment, the brightness release signal signifies a lack of user activity, that the electronic display is no longer in use, or the like. A computing device, such as the one or more computing devices 108, a controller, such as the display controller 104, or the like, may generate the brightness release signal. In one embodiment, a device generates the brightness release signal in response to a lack of one or more user activities for an amount of time, in response to a predefined user action, or the like. In this manner, the brightness level of the electronic display 106 remains at the intermediate brightness level during normal use, and increases to the default brightness level in response to a specific user activity.

In one embodiment, the minimum brightness module 208 dims the brightness level of the electronic display 206 from an intermediate brightness level to a minimum brightness level at a second dimming rate. The intermediate brightness level from which the minimum brightness module 208 dims the brightness level may be the same intermediate brightness level at which the plateau module maintains the brightness level, or may comprise a different intermediate brightness level selected from the one or more intermediate brightness levels, as is discussed in greater detail below with respect to the multiple plateau module 306 of FIG. 3.

The minimum brightness level, as described above, may be custom defined by the display management server 102, by a user, or the like. The minimum brightness level, in one embodiment, comprises a level at which the electronic display 106, a backlight of the electronic display 106, or the like is off or in a low power state. In another embodiment, the minimum brightness level may comprise a brightness level that is brighter than an off level, such that an image that the electronic display 106 displays may be minimally visible, but substantially indistinguishable or minimally distinguishable to a user.

Figure 3:
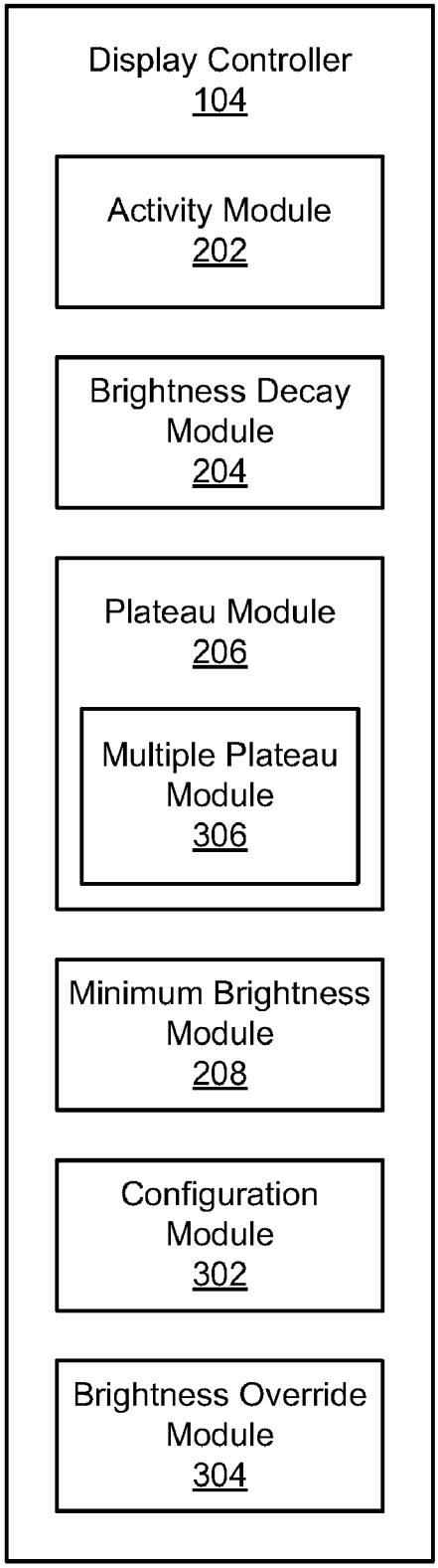
FIG. 3 is a schematic block diagram illustrating another embodiment of a display controller in accordance with the present invention.

FIG. 3 depicts another embodiment of the display controller 104. The display controller 104 depicted in FIG. 3, includes an activity module 202, a brightness decay module 204, a plateau module 206, and a minimum brightness module 208, which are substantially similar to those described in relation to the display controller 104 of FIG. 2. The display controller 104 includes a configuration module 302 and a brightness override module 304. In the depicted embodiment, the plateau module 206 further includes a multiple plateau module 306.

In one embodiment, the display controller includes a configuration module 302 that receives one or more custom definition of the intermediate brightness level, the default brightness level, the predefined period of time, the first dimming rate, the second dimming rate, the minimum brightness level, and/or other display settings. The configuration module 302 may receive custom definitions from the display management server 102, from a user through one of the user input devices 110, from one of the computing devices 108, from another module, or the like. In another embodiment, the configuration module 302 may use default definitions set by a manufacturer, a programmer, or the like.

The configuration module 302 may receive custom definitions over the display connection 112, over a network, directly from a user input device 110, etc. As described above with regard to the one or more display connections 112, a display connection 112 may include a VGA connection, a DVI connection, an HDMI connection, a component video connection, a composite video connection, a coaxial video connection, a display port connection, an S-video connection, a SCART connection, a D-Terminal connection, a serial port connection, a USB connection, a FireWire connection, an Ethernet connection, a Bluetooth connection, an IEEE 802.11 wireless connection, a DDC I2C communications bus, or the like. The configuration module 302 provides the custom definitions to the activity module 202, the brightness decay module 204, the plateau module 206, and the minimum brightness module 208.

In one embodiment, the brightness override module 304 temporarily sets the brightness level of the electronic display 106 to a brightness level that is higher than the maximum normal use brightness level. For example, in one embodiment, the brightness override module 304 may allow a user to override a manufacturer-set maximum normal use brightness level during abnormally bright use conditions, for testing, or the like. Using the electronic display 106 at the higher brightness level may decrease a lifetime of the electronic display 106 at an accelerated rate, and may not be advisable under normal conditions.

The brightness override module 304 may return the brightness level to a normal brightness level after a predefined period of time, in response to a user action, in response to a restart or power off of the electronic display 106, or the like. The brightness override module 304, in one embodiment, may set the brightness level to the higher brightness level in response to an action by a user, such as a menu selection from an OSD, or the like.

In one embodiment, the multiple plateau module 306 dims the brightness level of the electronic display 106 from the intermediate brightness level to one or more additional intermediate brightness levels at a dimming rate. The multiple plateau module 306 maintains the brightness level of the electronic display 106 at each of the additional intermediate brightness levels for one or more predefined periods of time. As described above, the plateau module 206 maintains the brightness level at the intermediate brightness level for a predefined period of time, such as a predefined period of time after the plateau module 206 receives a brightness release signal, or the like.

For example, in one embodiment, the plateau module 206 maintains the brightness level at an intermediate brightness level for a predefined period of time, and the multiple plateau module 306 dims the brightness level from the intermediate brightness level to an additional intermediate brightness level, and maintains the brightness level there for a predefined period of time. The minimum brightness module 208 may dim the brightness level from the additional intermediate brightness level to a minimum brightness level, or the multiple plateau module 306 may first dim the brightness level to another additional intermediate brightness level. The multiple plateau module 306 allows the brightness level to remain at one or more lower brightness levels for a predefined period of time before the minimum brightness module 208 dims the brightness level to the minimum brightness level.

Like other display settings described above, the one or more additional intermediate brightness levels, dimming rates, and predefined periods of time may be defined by the display management server 102, a user, a manufacturer, or the like. Having multiple plateaus of intermediate brightness levels allows the electronic display 106 to remain at a visible, usable intermediate brightness level, and then to decrease to a less visible but lower power state for a predefined period of time, before eventually dimming to the minimum brightness level which, for example, could be an off state.

Figure 4A:
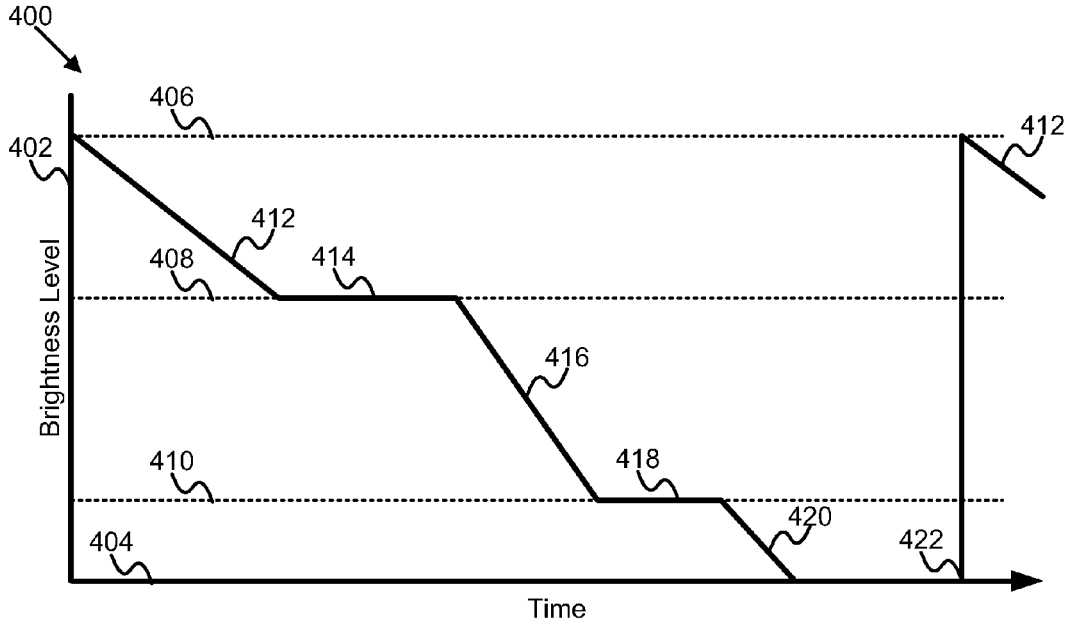
FIG. 4A is a schematic graph illustrating one embodiment of a brightness level of an electronic display in accordance with the present invention.

FIG. 4A depicts one embodiment of a brightness level 400 of an electronic display 106 over time, with linear dimming rates and multiple brightness level plateaus. In the depicted embodiment, the Y axis 402 represents a brightness level of the electronic display 106, and the X axis 404 represents time. The brightness level 400 begins at a default brightness level 406. The brightness decay module 204 dims the brightness level 400 from the default brightness level 406 to an intermediate brightness level 408 at a first dimming rate 412. In the depicted embodiment, the first dimming rate 412 is linear.

The plateau module 206 maintains the brightness level 400 at the intermediate brightness level 408 for a predefined period of time 414. The multiple plateau module 306 dims the brightness level 400 from the intermediate brightness level 408 to an additional intermediate brightness level 410 at a dimming rate 416 and maintains the brightness level 400 at the additional intermediate brightness level 410 for a predefined period of time 418. The dimming rate 416, in the depicted embodiment is linear.

The minimum brightness module 208 dims the brightness level 400 from the additional intermediate brightness level 410 to a minimum brightness level along the X axis 404 at a second dimming rate 420. In the depicted embodiment, the second dimming rate 420 is also linear. At time 422, the activity module 202 receives a brightness restore signal and sets the brightness level 400 to the default brightness level 406. In the depicted embodiment, the minimum brightness level 404 is zero, where the electronic display 106 is off, but the minimum brightness level 404 may be at some higher level. In response to the activity module 202 setting the brightness level 400 to the default brightness level 406, the brightness decay module 204 substantially immediately begins dimming the brightness level 400 at the first dimming rate 412.

The area between the brightness level 400 and the default brightness level 406 represents power that is saved by dimming the brightness level of the electronic display 106 instead of maintaining the brightness level at the default brightness level 406. The area may also represent an increase in the lifetime of the electronic display 106 over maintaining the brightness level at the default brightness level 406.

Figure 4B:
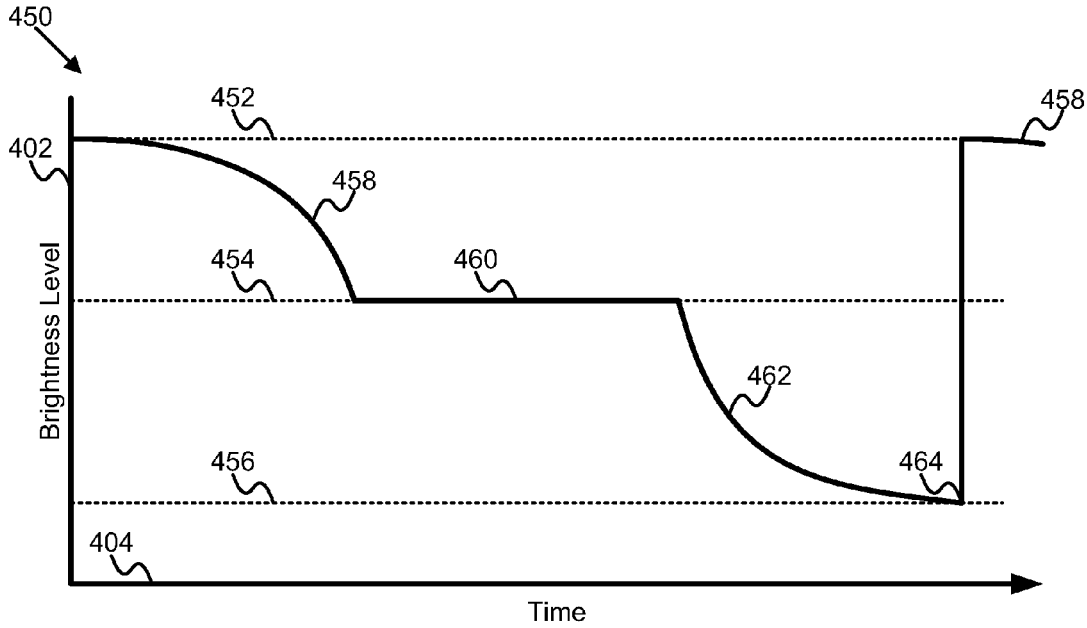
FIG. 4B is a schematic graph illustrating another embodiment of a brightness level of an electronic display in accordance with the present invention.

FIG. 4B depicts one embodiment of a brightness level 450 of an electronic display 106 over time with nonlinear dimming rates and a single brightness level plateau. The brightness level 450 begins at a default brightness level 452. The brightness decay module 204 dims the brightness level 450 from the default brightness level 452 to an intermediate brightness level 454 at a first dimming rate 458. In the depicted embodiment, the first dimming rate 458 is nonlinear, and a slope of the first dimming rate 458 increases as the brightness level 450 approaches the intermediate brightness level 454.

The plateau module 206 maintains the brightness level 450 at the intermediate brightness level 454 for a predefined period of time 460. The minimum brightness module 208 dims the brightness level 450 from the intermediate brightness level 454 to a minimum brightness level 456 at a second dimming rate 462. In the depicted embodiment, the second dimming rate 420 is nonlinear, and a slope of the second dimming rate 462 decreases as the brightness level 450 approaches the minimum brightness level 456.

At time 464, the activity module 202 receives a brightness restore signal and sets the brightness level 450 to the default brightness level 452. In response to the activity module 202 setting the brightness level 450 to the default brightness level 452, the brightness decay module 204 substantially immediately begins dimming the brightness level 450 at the first dimming rate 458.

Figure 5:
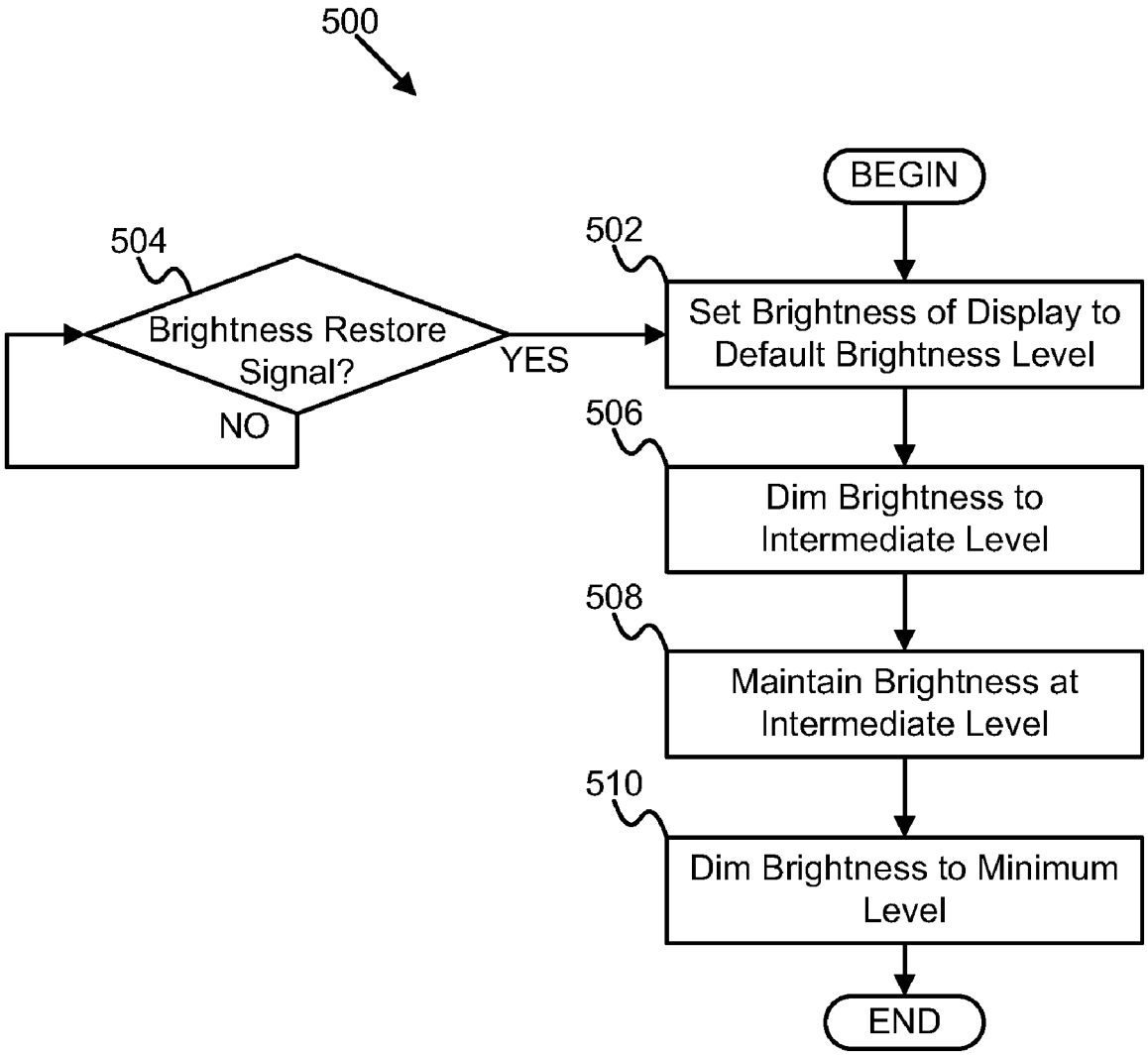
FIG. 5 is a schematic flow chart diagram illustrating one embodiment of a method for controlling an electronic display in accordance with the present invention.

FIG. 5 depicts one embodiment of a method 500 for controlling an electronic display. The method 500 begins, and the activity module 202 sets 502 the brightness level of the electronic display 106 to a default brightness level. The activity module 202, throughout the method 500, determines 504 whether there is a brightness restore signal. If the activity module 202 determines 504 that there is a brightness restore signal, the method 500 returns to the setting step 502, and the activity module 202 sets 502 the brightness level to the default brightness level. If the activity module 202 determines 504 that there is no brightness restore signal, the method 500 continues, and the activity module 202 continues to determine 504 whether there is a brightness restore signal as the method 500 continues.

The brightness decay module 204 dims 506 the brightness level of the electronic display 106 to an intermediate brightness level at a first dimming rate. The intermediate brightness level may be selected from one or more intermediate brightness levels. The plateau module 206 maintains 508 the brightness level of the electronic display 106 at the intermediate brightness level for a predefined period of time, such as an amount of time after receiving a brightness release signal. The minimum brightness module 208 dims 510 the brightness level of the electronic display 106 from an intermediate brightness level to a minimum brightness level at a second dimming rate, and the method 500 ends. As described above, if the activity module 202 determines 504 during the method 500 that there is a brightness restore signal, through a hardware or software interrupt, through polling, or the like, the activity module 202 returns the method 500 to the setting step 502 and sets 502 the brightness level to the default brightness level.

Figure 6:
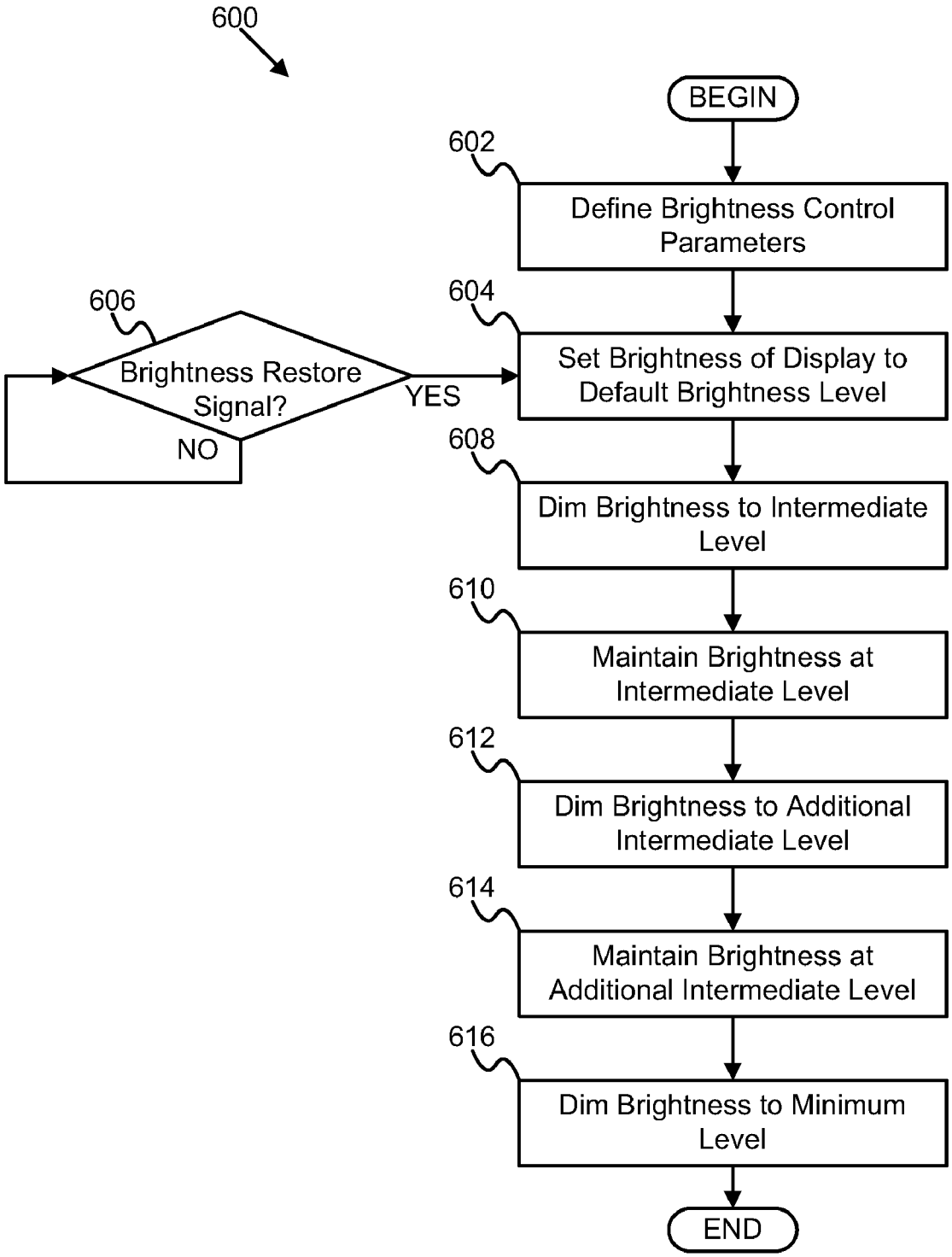
FIG. 6 is a schematic flow chart diagram illustrating another embodiment of a method for controlling an electronic display in accordance with the present invention.

FIG. 6 depicts one embodiment of a method 600 for controlling an electronic display using multiple brightness level plateaus at multiple intermediate brightness levels. The method 600 begins, and the configuration module 302 defines one or more brightness control parameters or display settings, such as intermediate brightness levels, a default brightness level, predefined periods of time, dimming rates, a minimum brightness level, and the like. The configuration module 302 may receive custom definitions of the brightness control parameters from the display management server 102, from a user, from the computing device 108, from another module, or the like, or the configuration module 302 may use default settings.

The activity module 202 sets 604 the brightness level of the electronic display 106 to the default brightness level. The activity module 202, throughout the method 600, as described above with regard to FIG. 5, determines 606 whether there is a brightness restore signal. If the activity module 202 determines 606 that there is a brightness restore signal, the method 600 returns to the setting step 604, and the activity module 202 sets 604 the brightness level to the default brightness level. If the activity module 202 determines 606 that there is no brightness restore signal, the method 600 continues, and the activity module 202 continues to determine 606 whether there is a brightness restore signal as the method 600 continues.

The brightness decay module 204 dims 608 the brightness level of the electronic display 106 to an intermediate brightness level at a first dimming rate. The intermediate brightness level may be selected from one or more intermediate brightness levels. The plateau module 206 maintains 610 the brightness level of the electronic display 106 at the intermediate brightness level for a predefined period of time, such as an amount of time after receiving a brightness release signal. The multiple plateau module 306 dims 612 the brightness level of the electronic display 106 to an additional intermediate brightness level at a dimming rate, and maintains 614 the brightness level at the additional intermediate brightness level for a predefined period of time. In a further embodiment, the multiple plateau module 306 may repeat the dimming step 612 and the maintaining step 614 for a plurality of additional intermediate brightness levels.

The minimum brightness module 208 dims 616 the brightness level of the electronic display 106 from an additional intermediate brightness level set by the multiple plateau module 306 to a minimum brightness level at a second dimming rate, and the method 600 ends. As described above, if the activity module 202 determines 606 during the method 600 that there is a brightness restore signal, the activity module 202 returns the method 600 to the setting step 604 and sets 604 the brightness level to the default brightness level.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to control an electronic display, the apparatus comprising:

an activity module that receives a brightness restore signal and sets a brightness level of an electronic display to a default brightness level in response to the brightness restore signal;

a brightness decay module that dims the brightness level of the electronic display from the default brightness level to an intermediate brightness level at a first dimming rate, the intermediate brightness level selected from one or more intermediate brightness levels, wherein the first dimming rate is such that a time that the brightness level decreases from the default brightness level to the intermediate brightness level is such that the user perceives the decrease in the brightness level as a gradual dim from the default brightness level to the intermediate brightness level, and wherein dimming the brightness level decreases power consumption of the electronic display;

a plateau module that maintains the brightness level of the electronic display at the intermediate brightness level for a predefined period of time, wherein the predefined period of time begins in response to dimming by the brightness decay module reaching the intermediate brightness level, and wherein the brightness level is maintained at the intermediate brightness level for the predefined period of time, the defined time period comprising a time period long enough such that the user perceives the brightness level to remain constant at the intermediate brightness level during the default time period; and a minimum brightness module that dims the brightness level of the electronic display from the intermediate brightness level to a minimum brightness level at a second dimming rate, wherein the dimming at the second dimming rate begins in response to the end of the predefined period of time, wherein the second dimming rate is such that a time that the brightness level decreases from the intermediate brightness level to the minimum brightness level is such that the user perceives the decrease in the brightness level as a gradual dim from the intermediate brightness level to the minimum brightness level, wherein the minimum brightness module maintains the electronic display at the minimum brightness level until one of the activity module receives a brightness restore signal and the electronic display is turned off.

2. The apparatus of claim 1, further comprising a configuration module that receives a custom definition of at least one of the intermediate brightness level, the default brightness level, the predefined period of time, the first dimming rate, the second dimming rate, and the minimum brightness level, the first dimming rate, the predefined period of time, and second dimming rate defined such that the user perceives the predefined period of time and a time that the electronic display dims from the default brightness level to the intermediate brightness level and from the intermediate brightness level to the minimum brightness level.

3. The apparatus of claim 2, wherein the configuration module receives the custom definition over a network from a display management server that manages display settings for a plurality of electronic displays.

4. The apparatus of claim 2, wherein the configuration module receives the custom definition over a Display Data Channel ("DDC") Inter-Integrated Circuit ("I2C") communications bus.

5. The apparatus of claim 1, wherein the predefined period of time begins running in response to the plateau module receiving a brightness release signal.

6. The apparatus of claim 1, further comprising a multiple plateau module that dims the brightness level of the electronic display from the intermediate brightness level to one or more additional intermediate brightness levels at a dimming rate and maintains the brightness level of the electronic display at each of the additional intermediate brightness levels for one or more predefined periods of time, the dimming rate and the predefined periods of time at the additional intermediate brightness levels defined such that the user perceives the predefined periods of time and a time that the electronic display dims between brightness levels.

7. The apparatus of claim 1, further comprising a brightness override mode module that temporarily sets the brightness level of the electronic display to a brightness level higher than a maximum normal use brightness level.

8. The apparatus of claim 1, wherein the brightness decay module begins dimming the brightness level of the electronic display from the default brightness level to the intermediate brightness level substantially immediately in response to the activity module setting the brightness level of the electronic display to the default brightness level.

9. The apparatus of claim 8, wherein the brightness decay module begins dimming the brightness level of the electronic display within about ten seconds of the activity module setting the brightness level of the electronic display to the default brightness level.

10. The apparatus of claim 1, wherein the activity module receives the brightness restore signal from a user input device.

11. The apparatus of claim 1, wherein dimming the brightness level of the electronic display comprises dimming the brightness level of the electronic display in discrete increments that are imperceptible to a user.

12. The apparatus of claim 1, wherein the first dimming rate and the second dimming rate comprise nonlinear dimming rates.

13. The apparatus of claim 12, wherein a slope of the first dimming rate increases as the brightness level of the electronic display approaches the intermediate brightness level and wherein a slope of the second dimming rate decreases as the brightness level of the electronic display approaches the minimum brightness level.

14. The apparatus of claim 1, wherein the intermediate brightness level comprises a visible brightness level, wherein a displayed image is distinguishable to a user at the visible brightness level, and further wherein the electronic display is off at the minimum brightness level.

15. An apparatus to control an electronic display, the apparatus comprising:

a configuration module that receives a custom definition of at least one of a default brightness level, an intermediate brightness level, a predefined period of time, a first dimming rate, a second dimming rate, and a minimum brightness level over a network from a display management server over a Display Data Channel ("DDC") Inter-Integrated Circuit ("I2C") communications bus, the display management server managing display settings for a plurality of electronic displays;

an activity module that receives a brightness restore signal from a user input device and sets a brightness level of an electronic display to the default brightness level in response to the brightness restore signal;

a brightness decay module that dims the brightness level of the electronic display from the default brightness level to the intermediate brightness level at the first dimming rate, the intermediate brightness level selected from one or more intermediate brightness levels, wherein the first dimming rate is such that a time that the brightness level decreases from the default brightness level to the intermediate brightness level is such that the user perceives the decrease in the brightness level as a gradual dim from the default brightness level to the intermediate brightness level, and wherein dimming the brightness level decreases power consumption of the electronic display;

a plateau module that maintains the brightness level of the electronic display at the intermediate brightness level for the predefined period of time, the predefined period of time beginning to run in response to the plateau module receiving a brightness release signal, and wherein the brightness level is maintained at the intermediate brightness level for the predefined period of time, the defined time period comprising a time period long enough such that the user perceives the brightness level to remain constant at the intermediate brightness level during the default time period; and a minimum brightness module that dims the brightness level of the electronic display from the intermediate brightness level to the minimum brightness level at the second dimming rate, wherein the dimming at the second dimming rate begins in response to the end of the predefined period of time, wherein the second dimming rate is such that a time that the brightness level decreases from the intermediate brightness level to the minimum brightness level is such that the user perceives the decrease in the brightness level as a gradual dim from the intermediate brightness level to the minimum brightness level, wherein the minimum brightness module maintains the electronic display at the minimum brightness level until one of the activity module receives a brightness restore signal and the electronic display is turned off.

16. A system to control an electronic display, the system comprising:

an electronic display having a brightness level that is adjustable;

a display controller that sets the brightness level of the electronic display, the display controller comprising, an activity module that receives a brightness restore signal and sets the brightness level of the electronic display to a default brightness level in response to the brightness restore signal;

a brightness decay module that dims the brightness level of the electronic display from the default brightness level to an intermediate brightness level at a first dimming rate, the intermediate brightness level selected from one or more intermediate brightness levels, wherein the first dimming rate is such that a time that the brightness level decreases from the default brightness level to the intermediate brightness level is such that the user perceives the decrease in the brightness level as a gradual dim from the default brightness level to the intermediate brightness level, and wherein dimming the brightness level decreases power consumption of the electronic display;

a plateau module that maintains the brightness level of the electronic display at the intermediate brightness level for a predefined period of time, wherein the predefined period of time begins in response to the dimming decay module dimming the brightness level to the intermediate brightness level, and wherein the brightness level is maintained at the intermediate brightness level for the predefined period of time, the defined time period comprising a time period long enough such that the user perceives the brightness level to remain constant at the intermediate brightness level during the default time period; and a minimum brightness module that dims the brightness level of the electronic display from the intermediate brightness level to a minimum brightness level at a second dimming rate, wherein the dimming at the second dimming rate begins in response to the end of the predefined period of time, wherein the second dimming rate is such that a time that the brightness level decreases from the intermediate brightness level to the minimum brightness level is such that the user perceives the decrease in the brightness level as a gradual dim from the intermediate brightness level to the minimum brightness level, wherein the minimum brightness module maintains the electronic display at the minimum brightness level until one of the activity module receives a brightness restore signal and the electronic display is turned off.

17. The system of claim 16, further comprising a display management server that manages display settings for the electronic display and for a plurality of additional electronic displays and defines at least one of the intermediate brightness level, the default brightness level, the predefined period of time, the first dimming rate, the second dimming rate, and the minimum brightness level over a network.

18. A method for controlling an electronic display, the method comprising:

receiving a brightness restore signal;

setting a brightness level of an electronic display to a default brightness level in response to the brightness restore signal;

dimming the brightness level of the electronic display from the default brightness level to an intermediate brightness level at a first dimming rate, the intermediate brightness level selected from one or more intermediate brightness levels, wherein the predefined period of time begins in response to the brightness level reaching the intermediate brightness level, wherein the first dimming rate is such that a time that the brightness level decreases from the default brightness level to the intermediate brightness level is such that the user perceives the decrease in the brightness level as a gradual dim from the default brightness level to the intermediate brightness level, and wherein dimming the brightness level decreases power consumption of the electronic display;

maintaining the brightness level of the electronic display at the intermediate brightness level for a predefined period of time, the defined time period comprising a time period long enough such that the user perceives the brightness level to remain constant at the intermediate brightness level during the default time period;

dimming the brightness level of the electronic display from an intermediate brightness level to a minimum brightness level at a second dimming rate, wherein the dimming at the second dimming rate begins in response to the end of the predefined period of time, wherein the second dimming rate is such that a time that the brightness level decreases from the intermediate brightness level to the minimum brightness level is such that the user perceives the decrease in the brightness level as a gradual dim from the intermediate brightness level to the minimum brightness level, wherein maintaining the electronic display at the minimum brightness level until one of receiving a brightness restore signal and turning of the electronic display.

19. The method of claim 18, further comprising dimming the brightness level of the electronic display from the intermediate brightness level to a second intermediate brightness level and maintaining the brightness level of the electronic display at the second intermediate brightness level for a second predefined period of time.

* * * * *